US005836814A

United States Patent [19]

Cunningham, Jr.

[11] Patent Number: 5,836,814

[45] Date of Patent: Nov. 17, 1998

[54] DAMPER BLADE SYSTEM

[75] Inventor: Robert Ashley Cunningham, Jr., Argyle, Tex.

[73] Assignee: NRG Industries, Inc., Carrollton, Tex.

[21] Appl. No.: 714,571

[22] Filed: Sep. 16, 1996

[51] Int. Cl.[6] ..... F24F 13/15

[52] U.S. Cl. ..... 454/234; 136/601; 454/236

[58] Field of Search ..... 454/228, 234, 454/235, 236, 268; 137/601

[56] References Cited

U.S. PATENT DOCUMENTS

| | | | |
|---|---|---|---|
| 3,212,424 | 10/1965 | Davis | 454/268 |
| 3,746,042 | 7/1973 | Finkel | 137/601 |
| 3,847,210 | 11/1974 | Wells | 137/601 X |
| 4,506,825 | 3/1985 | Grant | 137/601 X |

*Primary Examiner*—Harold Joyce
*Attorney, Agent, or Firm*—Jenkens & Gilchrist P.C.

[57] ABSTRACT

A damper blade system for positioning proximate a duct includes a housing with two, opposing sides; a first damper blade; and a second damper blade. The first damper blade is rotatably supported between the two sides of the housing, and one end of the first damper blade is coupled to a damper gear. The second damper blade is also rotatably supported between two sides of the housing adjacent the first damper blade, and one end of the second damper blade is coupled to another damper gear. The system further includes a support disposed on the side of the housing with the damper gears; a rack, having a plurality of teeth engaging the damper gears, movably disposed in the support; and a drive means for moving the rack along the support.

15 Claims, 10 Drawing Sheets

DAMPER BLADE SYSTEM

This invention relates generally to damper blade systems, and is more particularly directed to damper blade systems used in heating, ventilating, and air conditioning (HVAC) systems.

BACKGROUND OF THE INVENTION

Damper blade systems are required in many industrial applications and in almost all commercial, and large residential, HVAC systems. Typically, such damper blade systems are used. to control the flow of air through a duct or conduit. In addition, such damper blade systems are often used to simultaneously control the flow of air through a return air duct and a fresh air duct of a HVAC system.

FIG. 1 is a schematic showing such a damper blade system in a conventional HVAC system 10 positioned on a roof 12 of a building 20. HVAC system 10 has a housing 14 in fluid communication with a supply air duct 16 and a return air duct 18, both of which are in fluid communication with the interior of building 20. Housing 14 has a relief air duct (outlet) 22 and a fresh air duct (intake) 24 in fluid communication with the external surroundings. Within housing 14 are a fresh air damper 26 and a return air damper 28, both of which are actuated by a control motor 30. Also within housing 14 are an enthalpy control 32, a mixed air sensor 34, a blower 36, a compressor 38, a relief damper 39, as well as other conventional HVAC elements. A thermostat 40 is located within building 20. Thermostat 40, enthalpy control 32, control motor 30, mixed air sensor 34, and compressor 38 form the basic elements of an electro-mechanical control system 42 for HVAC system 10, as indicated by the dashed line in FIG. 1. In addition, the flow of air through HVAC system 10 is generally indicated by bolded arrows in FIG. 1.

Control motor 30 can actuate fresh air damper 26 to any position between fully closed (all damper blades at 0 degrees with respect to y-axis) and filly open (all damper blades at 90 degrees with respect to y-axis). Similarly, control motor 30 can actuate return air damper 28 to any position between fully closed (all damper blades at 0 degrees with respect to x-axis) and fully open (all damper blades at 90 degrees with respect to x-axis). Preferably, the individual damper blades of fresh air damper 26 rotate in sequence, and the individual damper blades of return air damper 28 rotate in sequence. In addition, control motor 30 preferably actuates fresh air damper system 26 and return air damper 28 in a "slaved" fashion. More particularly, when fresh air damper 26 is fully closed, return air damper 28 is fully open. Similarly, when fresh air damper 26 is fully open, return air damper 28 is fully closed. In addition, if fresh air damper 26 is open to a certain angle (e.g. 30 degrees), return air damper 28 is opened to the complimentary angle (e.g. 60 degrees). The rotation of the damper blades of fresh air damper 26 in sequence, the rotation of the damper blades of return air damper 28 in sequence, and the complimentary actuation of fresh air damper 26 and return air damper 28 are important to operating HVAC system 10 in the most economical manner, as is explained in greater detail below.

As one skilled in the HVAC art will recognize, fresh air damper 26 and return air damper 28, in combination with electromechanical control system 42, allow HVAC system 10 to cool in the most economical fashion by minimizing the use of compressor 38. As a first example, suppose the ambient air temperature is 88 degrees, and thermostat 40 calls for cooling. Assume also that the mixed air temperature set point for HVAC system 10, which is the desired temperature of air to be supplied to building 20, is 56 degrees. Enthalpy control 32 senses the relatively warm outside air, energizes compressor 38, and signals control motor 30 to move fresh air damper 26 to the fully closed position. Due to the complimentary actuation of fresh air damper 26 and return air damper 28, return air damper 28 is moved to the fully open position. As a second example using the same conditions except that the ambient temperature is only 60 degrees, enthalpy control 32 senses the relatively cool outside air and signals control motor 30 to move fresh air damper 26 to the fully open position and return air damper 28 to the fully closed position. Compressor 38 is only energized if second stage cooling is required, resulting in electricity cost savings. As a third example using the same conditions except that the ambient temperature is only 45 degrees, enthalpy control 32 senses the cool outside air and signals control motor 30 to open fresh air damper 26. As the ambient 45 degree air enters HVAC system 10, mixed air sensor 34 determines that the ambient air is below the desired set point of 56 degrees. In response, mixed air sensor 34 signals control motor 30 to partially close fresh air damper 26, and partially open return air damper 28, so that the mixed air provided to HVAC system 10 is maintained at 56 degrees. Compressor 38 is therefore never energized, resulting in even higher electricity cost savings.

Several known damper systems have been utilized in HVAC system 10. FIG. 2 illustrates one of these damper systems, damper system 50. Damper system 50 has a fresh air damper 52 and a return air damper 54 in a non-coplanar, 120 degree arrangement, in contrast to the non-coplanar, 90 degree arrangement of fresh air damper 26 and return air damper 28 of FIG. 1. Therefore, damper system 50 is utilized in installations having a fresh air duct with a longitudinal axis generally normal to the y-axis and a return air duct with a longitudinal axis generally normal to the x-axis, as shown in FIG. 2.

Fresh air damper 52 has damper blades 56, 57, and 58. Damper blade 56 has an end 56*a* and an opposing end 56*b* (not shown), both of which are rotatably supported in a housing 64 by conventional means, such as a circular shaft on damper blade 56 supported by a bushing within housing 64. Damper blade 57 has ends 57*a* and 57*b* (not shown), and damper blade 58 has ends 58*a* and 58*b* (not shown), all of which are rotatably supported in housing 64 in an identical manner to the ends of damper blade 56. Return air damper 54 has damper blades 59, 60, 61, 62, and 63. Damper blade 59 has ends 59*a* and 59*b* (not shown), damper blade 60 has ends 60*a* and 60*b* (not shown), damper blade 61 has ends 61*a* and 61*b* (not shown), damper blade 62 has ends 62*a* and 62*b* (not shown), and damper blade 63 has ends 63*a* and 63*b* (not shown), all of which are rotatably supported in housing 64 in an identical manner to the ends of damper blade 56.

Using various linkage systems, control motor 30 may rotate damper blades 56, 57, and 58 of fresh air damper 52 in sequence; rotate damper blades 59, 60, 61, 62, and 63 of return air damper 54 in sequence; and actuate fresh air damper 52 and return air damper 54 in a complimentary manner. In the exemplary linkage system 66 shown in FIG. 2, the shaft of control motor 30 is fixably coupled to a linkage 30*a* by a set screw 30*b*. Linkage 30*a* is fixably coupled to a damper rod 68 by set screw 30*c*, and damper rod 68 is pivotally coupled to a damper bracket 70. Damper bracket 70 is fixably coupled to damper blade 59 of return air damper 54. Damper brackets 59*c*, 60*c*, 61*c*, 62*c*, and 63*c* are fixably coupled to damper blades 59, 60, 61, 62, and 63, respectively. In addition, damper brackets 59*c*, 60*c*, 61*c*, 62*c*, and 63*c* are each pivotally coupled to a damper rod 72.

A damper bracket 74 is also fixably coupled to damper blade 59 and pivotally coupled to a damper rod 76. Damper rod 76 is pivotally coupled to a damper bracket 78, and damper bracket 78 is fixably coupled to damper blade 57 of fresh air damper 52. Damper brackets 56*c*, 57*c*, and 58*c* are fixably coupled to damper blades 56, 57, and 58, respectively. In addition, damper brackets 56*c*, 57*c*, and 58*c* are each pivotally coupled to a damper rod 79.

The pivotal coupling of damper rods to damper brackets in linkage system 66 is performed using conventional means. For example, the pivotal coupling of damper rod 76 to damper bracket 78 is accomplished using a bushing member 78*a* receiving damper rod 76, a set screw 78*b* fixably securing damper rod 76 within bushing member 78*a*, a pin 78*c* having one end fixably coupled to bushing member 78*a* and an opposing end fixably coupled to a bearing member 78*d*, and a damper bracket body 78*e* rotatably supporting bearing member 78*d*.

As shown in FIG. 2, as control motor 30 rotates in a counter-clockwise direction, damper blades 59, 60, 61, 62, and 63 of return air damper 54 begin to close in sequence, and damper blades 56, 57, and 58 of fresh air damper 52 begin to open in sequence. In addition, linkage system 66 actuates return air damper 54 and fresh air damper 52 in a complimentary manner, as is described above. For example, as shown in FIG. 2, when fresh air damper 52 is closed (all damper blades at 0 degrees with respect to y-axis), return air damper 54 is open (all damper blades at approximately 90 degrees with respect to x-axis).

Damper system 50 is subject to several problems. First, the positions of the linkages, damper rods, and damper brackets of linkage system 66 require precise adjustment during manufacturing so that control motor 30 rotates damper blades 56, 57, and 58 of fresh air damper 52 in sequence; rotates damper blades 59, 60, 61, 62, and 63 of return air damper 54 in sequence; and actuates fresh air damper 52 and return air damper 54 in a complimentary manner. However, if any of the set screws in linkage system 66 ever loosen, such sequential rotation and complimentary actuation is lost. Linkage system 66 is extremely difficult to readjust in the field due to the number of moving parts and the precise adjustment required. Second, even though the linkages, damper rods, and damper brackets of linkage system 66 are typically made of corrosion-resistant materials, some degree of corrosion may still occur over time, and this corrosion may cause sequential rotation problems or complimentary actuation problems. Third, damper system 50 is not typically used in. installations requiring damper blades having different widths because such installations require an even more complex linkage system than linkage system 66. This in turn creates a problem when one needs a damper system for a duct having a width not evenly divisible into a number of equal width damper blades.

FIGS. 3A, 3B, and 3C illustrate a second, known damper system 80. As shown in FIGS. 3A and 3B, damper system 80 has a fresh air damper 82 and a return air damper 84 in a coplanar arrangement, in contrast to the non-coplanar, 90 degree arrangement of fresh air damper 26 and return air damper 28 of FIG. 1. Therefore, damper system 80 is utilized in installations having a fresh air duct with a longitudinal axis generally normal to the x-axis and a return air duct with a longitudinal axis generally normal to the x-axis, as shown in FIG. 3A.

Fresh air damper 82 has interlocking damper gears 86, 88, 90, and 92 having hubs 86*b*, 88*b*, 90*b*, and 92*b*, respectively. Damper blades 86*a*, 88*a*, 90*a*, and 92*a* (shown as hidden lines) are coupled to damper gears 86, 88, 90, and 92 in a parallel fashion. Damper blades 86*a*, 88*a*, 90*a*, and 92*a* are also rotatably supported in a housing 102. Return air damper 84 has interlocking damper gears 94, 96, 98, and 100 having hubs 94*b*, 96*b*, 98*b*, and 100*b*, respectively. Damper blades 94*a*, 96*a*, 98*a*, and 100*a* (shown as hidden lines) are coupled to gears 94, 96, 98, and 100 in a parallel fashion. Damper blades 94*a*, 96*a*, 98*a*, and 100*a* are also rotatably supported in a housing 103. All damper gears in damper system 80 are conventional spur gears having the same diameter and the same number of involute gear teeth.

As shown in FIG. 3C, housing 103 has opposing sides 103*a* and 103*b*, a top 103*c*, and a bottom 103*d* (see FIG. 3A). Damper blade 98*a*, as well as all other damper blades in return air damper 84, are rotatably supported in housing 103 by bearings 104*a* and 104*b* riding within bushings 106*a* and 106*b*. Bushing 106*a* is supported within aperture 108*a* of side 103*a*, and bushing 106*b* is supported within aperture 108*b* of side 103*b*. Bearings 104*a* and 104*b* are fixably secured to each end of damper blade 98*a* by set screws 110, welding, or other conventional fastening means. Bearing 104*a* also extends through hub 98*b* of damper gear 98. Bearing 104*a* and damper gear 98 are fixably secured together by a key and mating key shafts (not shown) or other conventional fastening means. Fresh air damper 82 is constructed in an identical manner to return air damper 84, as shown in FIG. 3C.

Returning to FIG. 3A, the motion of fresh air damper 82 is slaved to return air damper 84 by the interlocking of damper gears 86 and 100. In addition, the damper blades of fresh air damper 82 are preferably oriented 90 degrees out of phase with the damper blades of return air damper 84. Therefore, control motor 30 (not shown) actuates fresh air damper 82 and return air damper 84 in a complimentary manner. For example, as shown in FIG. 3A, when fresh air damper 82 is fully open (all damper blades at 90 degrees with respect to x-axis), return air damper 84 is fully closed (all damper blades at 0 degrees with respect to x-axis). As another example, as shown in FIG. 3B, if fresh air damper 82 is open to 30 degrees with respect to the x-axis, return air damper 84 is opened to the complimentary angle of 60 degrees with respect to the x-axis. Contrary to damper system 50, damper system 80 rotates adjacent damper blades in opposite, rather than identical, directions.

Damper system 80 reduces the above-described precision adjustment problems common to damper system 50. However, in order for fresh air damper 82 and return air damper 84 to actuate in a complimentary manner, as is preferred, damper system 80 requires damper blades 86*a*, 88*a*, 90*a*, 92*a*, 94*a*, 96*a*, 98*a*, and 100*a* to all have equal widths. More specifically, damper gears 86, 88, 90, 92, 94, 96, 98, and 100 must have the same number of teeth. If the damper gears had varying numbers of teeth, the damper gears, and their associated damper blades, would rotate at different rates. According to conventional mating gear tooth design, damper gears with the same number of teeth generally have the same diameter. Therefore, the interlocking of constant diameter damper gears results in equal width damper blades. As discussed above, this in turn creates a problem when one needs a damper system for a duct having a width not evenly divisible into a number of equal. width damper blades.

Damper system 80 has an additional limitation. Even though a given damper system 80 requires that all damper blades have an equal width, different installations of damper system 80 may require varying damper blade widths. Such different installations thus require damper gears of varying diameters. The die required to cast a particular diameter of damper gear typically costs or the order of $15,000. Therefore, damper system 80 is often limited to high volume installations, requiring large numbers of gears so that the cost of the die can be spread over many gears.

It is therefore an object of the present invention to provide an improved damper system for positioning proximate to or in a duct which minimizes the number of moving parts and minimizes the degree of precision adjustment required during manufacturing, installation, and maintenance.

It is a further object of the present invention to provide such a damper system which may use damper blades of varying widths.

It is a further object of the present invention to provide such a damper system which minimizes manufacturing costs by requiring only a single die to cast its damper gears.

It is a further object of the present invention to provide such a damper system having a fresh air damper and a return air damper which are actuated in a complimentary manner.

Still other objects and advantages of the present invention will become apparent to those of ordinary skill in art having reference to the following specification together with its drawings.

SUMMARY OF THE INVENTION

The present invention is a damper blade system for positioning proximate a duct. The system includes a housing with two, opposing sides; a first damper blade; and a second damper blade. The first damper blade is rotatably supported between the two sides of the housing, and one end of the first damper blade is coupled to a damper gear. The second damper blade is also rotatably supported between two sides of the housing adjacent the first damper blade, and one end of the second damper blade is coupled to another damper gear. The system further includes support means disposed on the side of the housing with the damper gears; a rack, having a plurality of teeth engaging the damper gears, movably disposed in the support means; and a drive means for moving the rack along the support means.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

The preferred embodiments of the present invention and their advantages are best understood by referring to FIGS. 1 through 10 of the drawings, like numerals being used for like and corresponding parts of the various drawings.

Figure 1:
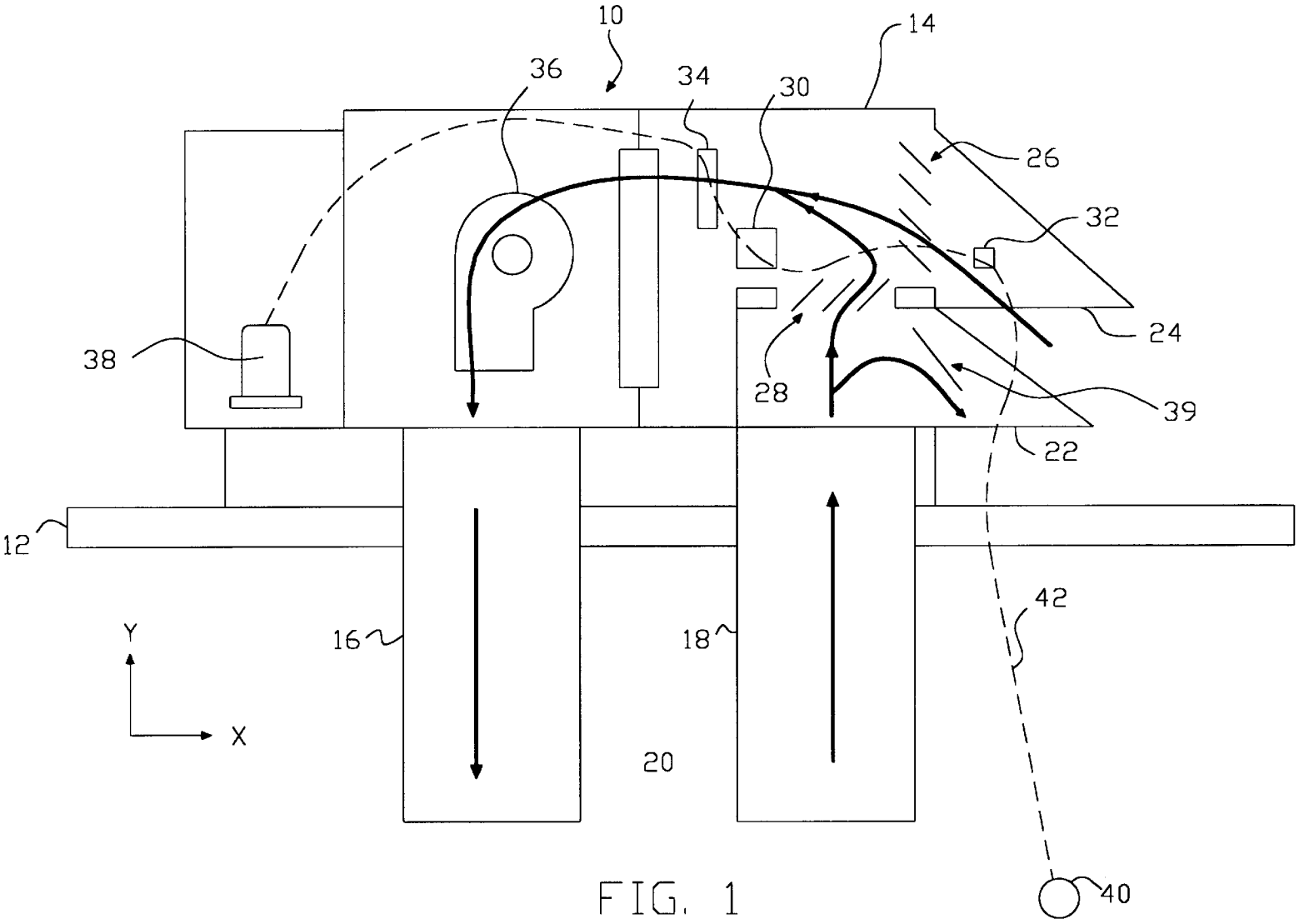
FIG. 1 (PRIOR ART)
FIG. 1 is a schematic of a conventional HVAC system.
Figure 2:
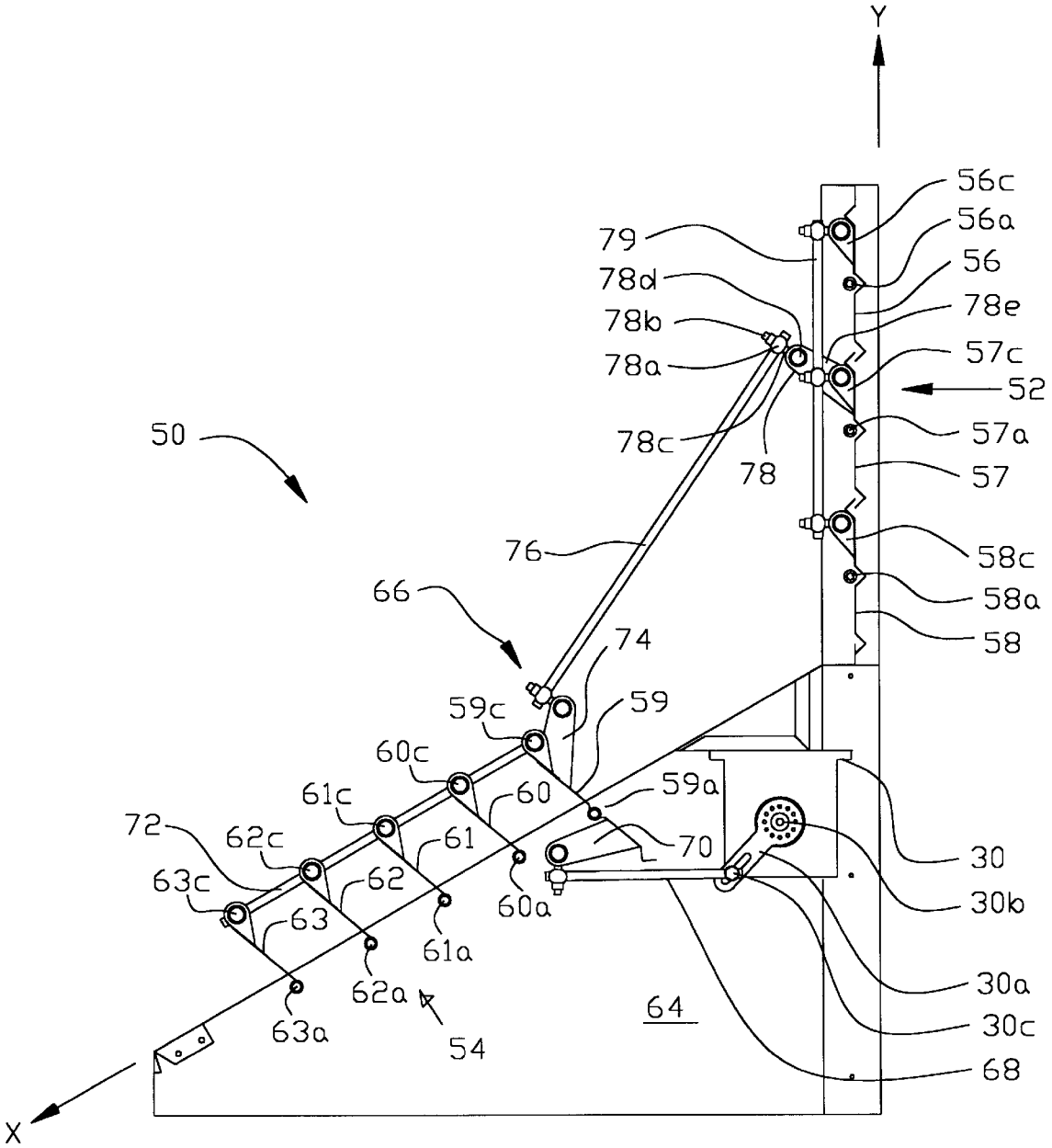
FIG. 2 (PRIOR ART)
FIG. 2 illustrates a first, known damper system used in a conventional HVAC system.
Figure 3A:
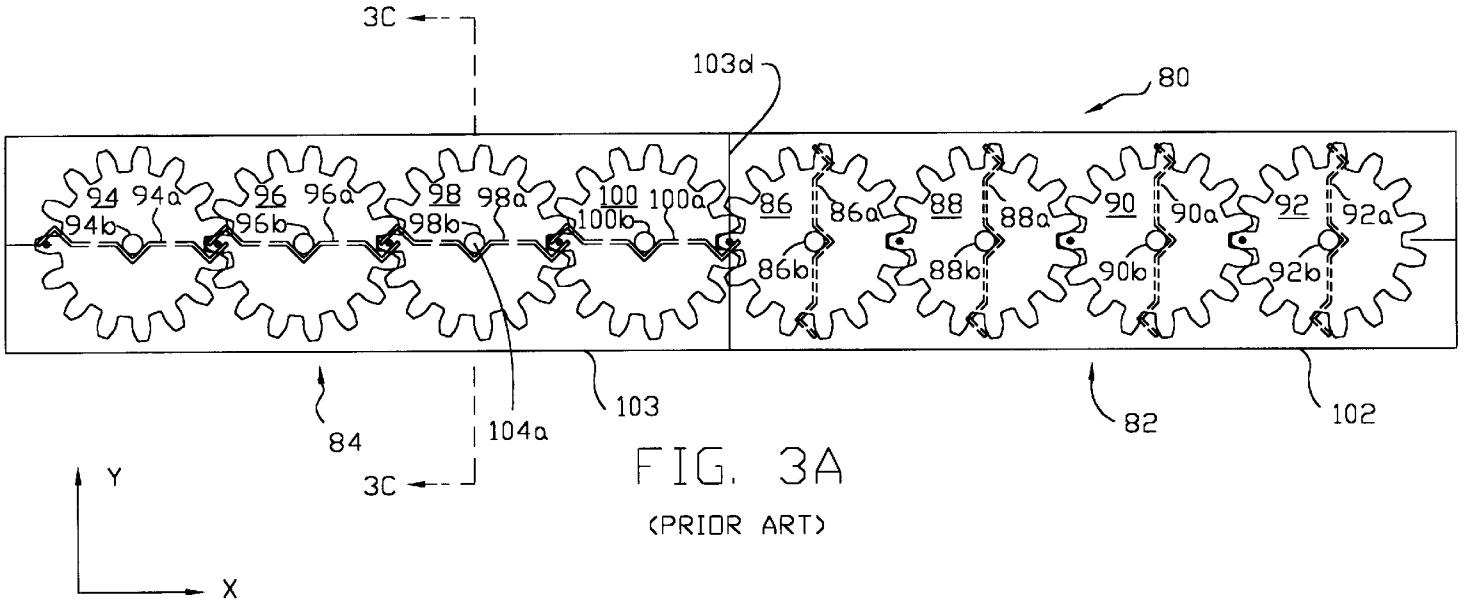
FIG. 3A (PRIOR ART)
FIG. 3A illustrates a second, known damper system used in a conventional HVAC system.
Figure 3B:
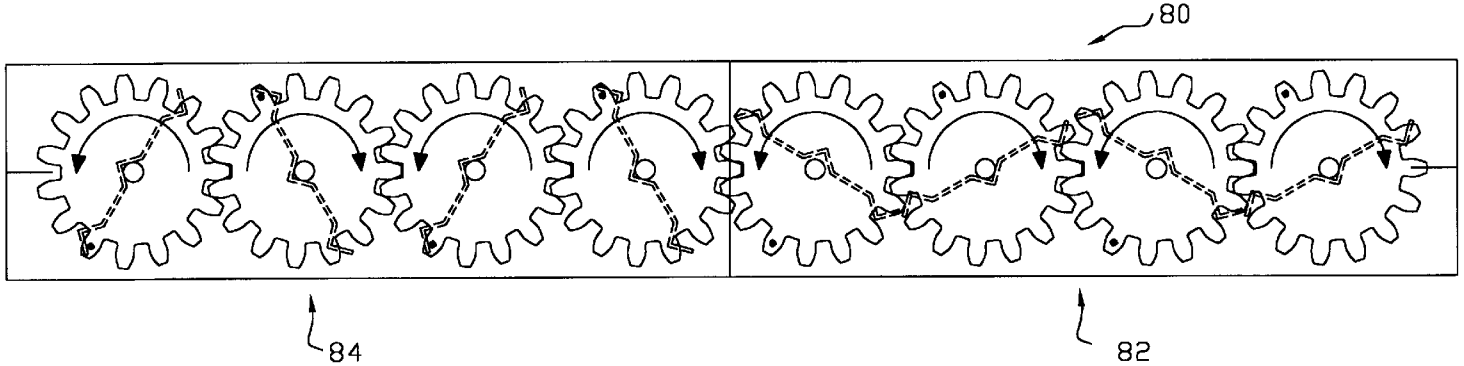
FIG. 3B (PRIOR ART)
FIG. 3B illustrates the complimentary actuation of the fresh air damper and the return air damper of the damper system of FIG. 3A.
Figure 3C:
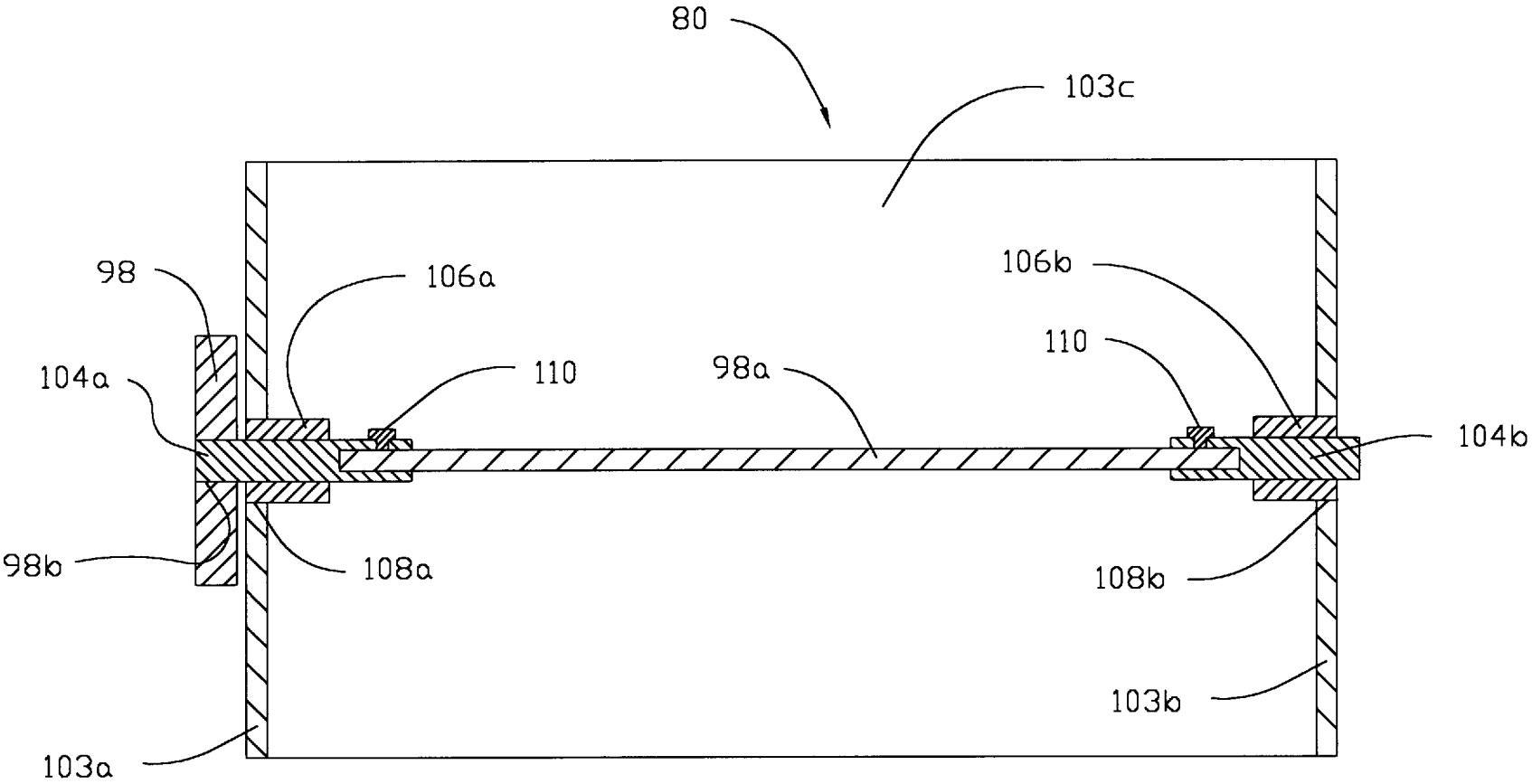
FIG. 3C (PRIOR ART)
FIG. 3C is a sectional view of FIG. 3A along line 3C—3C.
Figure 4A:
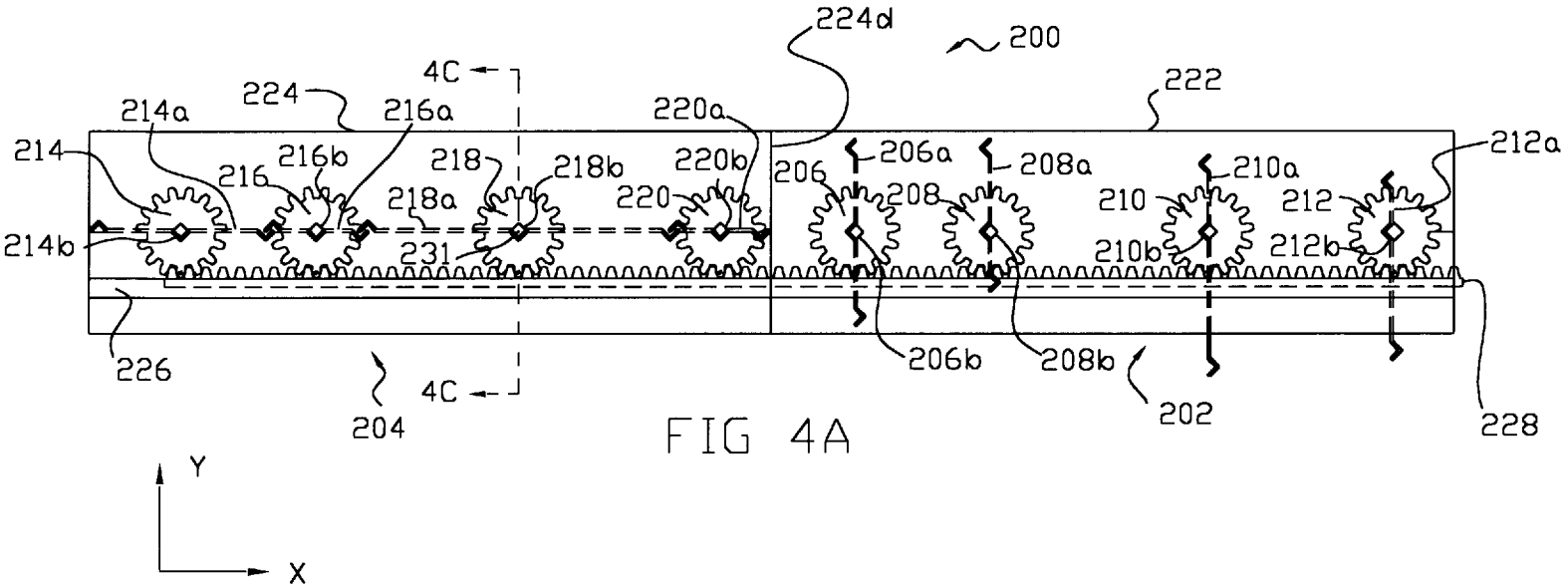
FIG. 4A illustrates the damper system of the present invention according to a first preferred. embodiment.
Figure 4B:
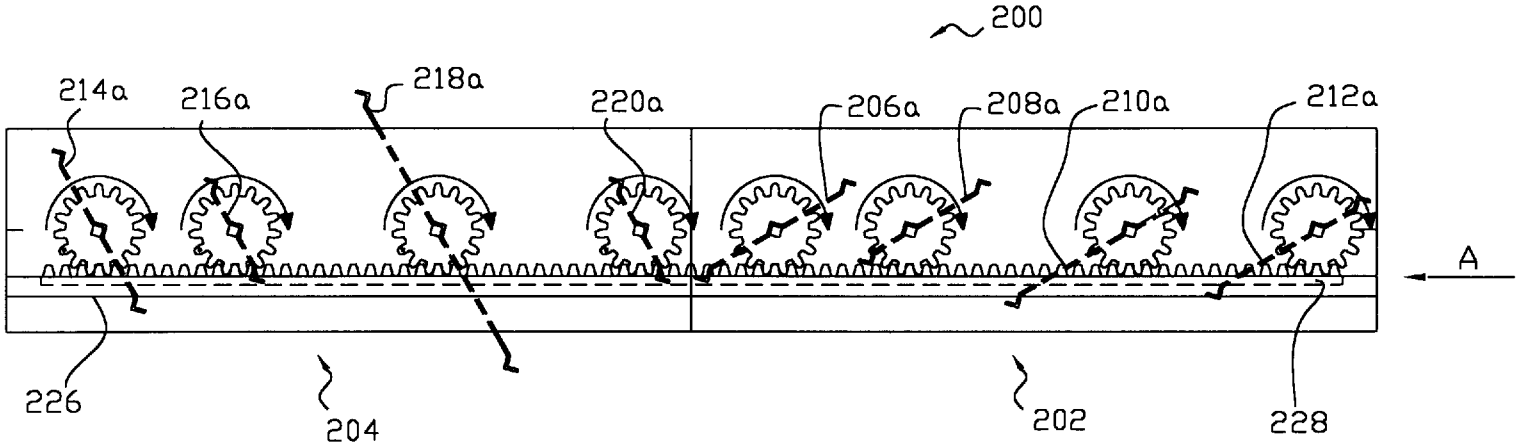
FIG. 4B illustrates the complimentary actuation of the fresh air damper and the return air damper of the damper system of FIG. 4A.
Figure 4C:
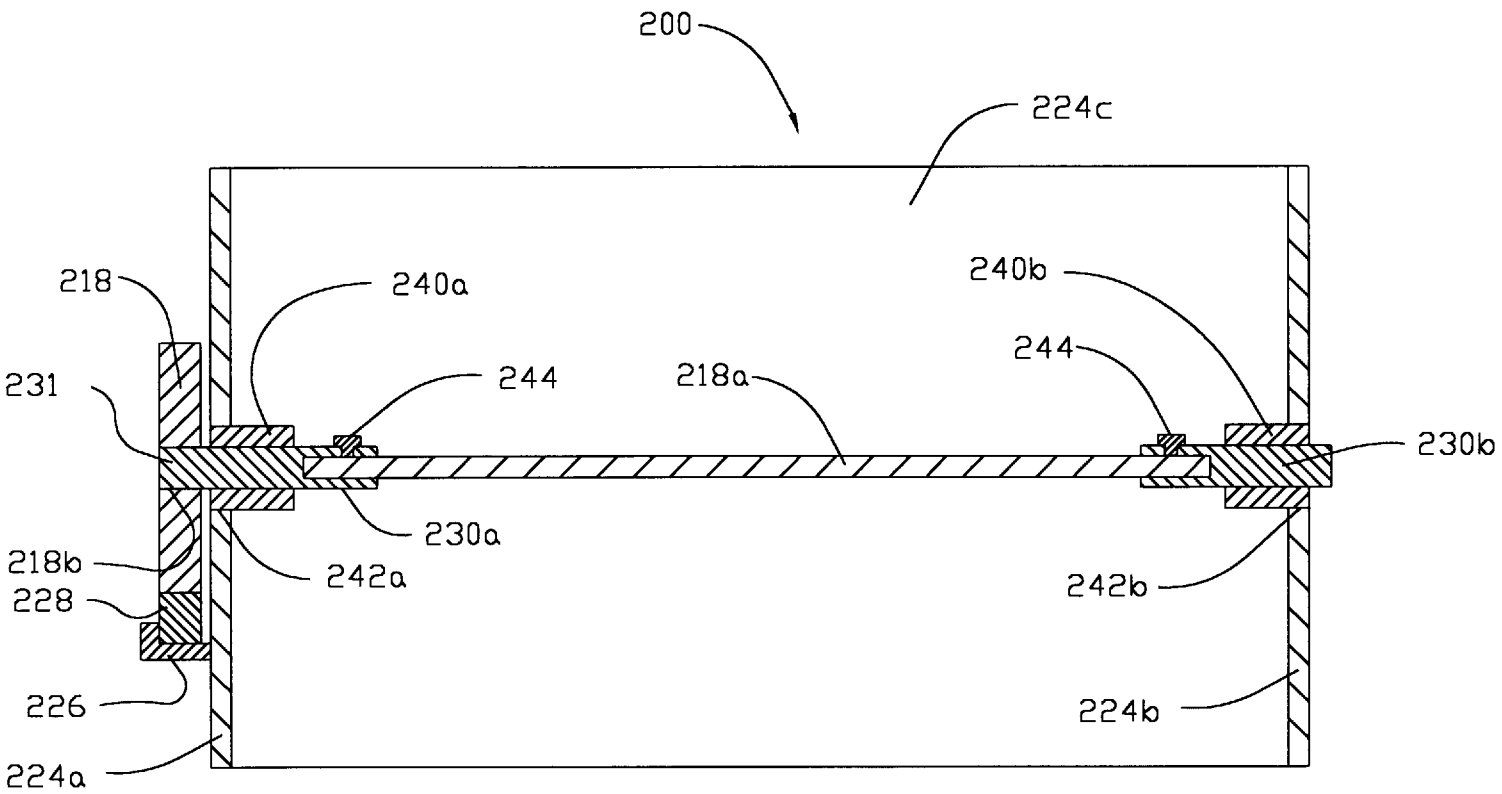
FIG. 4C is a sectional view of FIG. 4A along line 4C—4C.

FIGS. 4A, 4B, and 4C show a first preferred embodiment of the invention. As shown in FIGS. 4A and 4B, damper system 200 has a fresh air damper 202 and a return air damper 204 in a coplanar arrangement. Therefore, damper system 200 is utilized in installations having a fresh air duct with a longitudinal axis generally normal to the x-axis and a return air duct with a longitudinal axis generally normal to the x-axis, as shown in FIG. 4A.

Fresh air damper 202 has non-interlocking damper gears 206, 208, 210, and 212 having hubs, 206*b*, 208*b*, 210*b*, and 212*b*, respectively. Damper blades 206*a*, 208*a*, 210*a*, and 212*a* are preferably coupled to damper gears 206, 208, 210, and 212 in a parallel fashion. Damper blades 206*a*, 208*a*, 210*a*, and 212*a* are also rotatably supported in a housing 222. Return air damper 204 has non-interlocking damper gears 214, 216, 218, and 220 having hubs 214*b*, 216*b*, 218*b*, and 220*b*, respectively. Damper blades 214*a*, 216*a*, 218*a*, and 220*a* are preferably coupled to damper gears 214, 216, 218, and 220 in a parallel fashion. Damper blades 214*a*, 216*a*, 218*a*, and 220*a* are also rotatably supported in a housing 224. All damper gears in damper system 200 have substantially identical diameters and the same number of teeth. In addition, all damper gears in damper system 200 are preferably spur gears and preferably have involute gear teeth.

As shown in FIG. 4C, housing 224 has opposing sides 224*a* and 224*b*, a top 224*c*, and a bottom 224*d* (see FIG. 4A). Damper blade 218*a*, as well as all other damper blades in return air damper 204, is preferably rotatably supported in housing 224 by bearings 230*a* and 230*b* riding within bushings 240*a* and 240*b*. Bushing 240*a* is supported within aperture 242*a* of side 224*a*, and bushing 240*b* is supported within aperture 242*b* of side 224*b*. Bearings 230*a* and 230*b* are fixably secured to each end of damper blade 218*a* by set screws 244, welding, or other conventional fastening means. Bearing 230*a* also extends through hub 218*b* of damper gear 218. Bearing 230*a* and damper gear 218 are fixably secured together by a key and mating key shafts (not shown) or other conventional fastening means. For reasons explained in greater detail below, hub 218*b* preferably has a polygonal cross-section, such as a square, triangle, pentagon, hexagon, or other polygon. Bearing 230*a* also preferably has a portion 231 having a polygonal cross-section configured to mate with hub 218*b*. Fresh air damper 202 is preferably constructed in an identical manner to return air damper 204, as shown in FIG. 4C.

As shown best in FIGS. 4A and 4C, a support means 226 is disposed on the exterior of side 224*a*. Support means 226 is preferably a support having an L-shaped cross-section running the length of housing 222 and 224, and support means 226 is preferably made from aluminum or other conventional low friction material. A rack 228 is movably disposed within support means 226, and. rack 228 has a plurality of teeth engaging damper gears 206, 208, 210, 212, 214, 216, 218, and 220. Rack 228 and damper gears 206, 208, 210, 212, 214, 216, 218, and 220 are preferably made from a conventional wear resistant, low friction material such as Zamak 3, a zinc alloy.

One skilled in the art will appreciate that the exact geometry of support means 226 is not critical as long as it supports rack 228 in engagement with the damper gears and allows rack 228 to slidably move along the length of housings 222 and 224. For example, although not shown in the Figures, support means 226 could be a series of unconnected supports spaced along the length of housings 222 and 224. As another example, although not shown in the Figures, the bottom of rack 228 may have a semi-circular cross-section, and support means 226 could employ a mating, semi-circular cross-section.

Although not shown in the FIGS. 4A, 4B, and 4C, control motor 30 is rotatably coupled to rack 228 or one of the damper gears of damper system 200. This coupling is preferably accomplished by a drive gear coupled to rack 228, a shaft of control motor 30 coupled to a hub of a damper gear, or other conventional drive means.

Although damper system 200 is shown with both a fresh air damper 202 and a return air damper 204, the present invention is fully applicable in installations requiring only a single damper. For example, if a given installation had only a single duct, a single damper, similar to fresh air damper 202 or return air damper 204, could be employed.

As best shown by FIG. 4B, the non-interlocking damper gears of damper system 200 allow damper blades 206*a*, 208*a*, 210*a*, 212*a*, 214*a*, 216*a*, 218*a*, and 220*a* to have various widths. Such flexibility is critical in installations in ducts having widths not evenly divisible into a number of equal width damper blades. The motion of fresh air damper 202 is slaved to return air damper 204 by the combination of support means 226 and rack 228. For example, if control motor 30 (not shown) moves rack 228 in the direction of arrow A in FIG. 4B, damper gears 206, 208, 210, and. 212 of fresh air damper 202 and damper gears 214, 216, 218, and 220 of return air damper 204 each rotate clockwise by the same angular displacement. In addition, as shown best by FIG. 4A, the damper blades of fresh air damper 202 are preferably oriented 90 degrees out of phase with the damper blades of return air damper 204. Therefore, control motor 30 (not shown) actuates fresh air damper 202 and return air damper 204 in a complimentary manner. For example, as shown in FIG. 4A, when fresh air damper 202 is fully open (all damper blades at 90 degrees with respect to the x-axis), return air damper 204 is fully closed (all damper blades at 0 degrees with respect to the x-axis). As another example, as shown in FIG. 4B, if fresh air damper 202 is open to 30 degrees with respect to the x-axis, return air damper 204 is opened to the complimentary angle of 60 degrees with respect to the x-axis.

Of course, although not shown in FIGS. 4A and 4B, damper system 200 can also be implemented so that damper blades 206*a*, 208*a*, 210*a*, 212*a*, 214*a*, 216*a*, 218*a*, and 220*a* have equal widths. In addition, although FIGS. 4A and 4B show fresh air damper 202 as having four damper blades and return air damper 204 as having four damper blades, fresh air damper 202 and return air damper 204 can have fewer or greater numbers of damper blades, and fresh air damper 202 can have a different number of damper blades than return air damper 204.

Figure 5A:
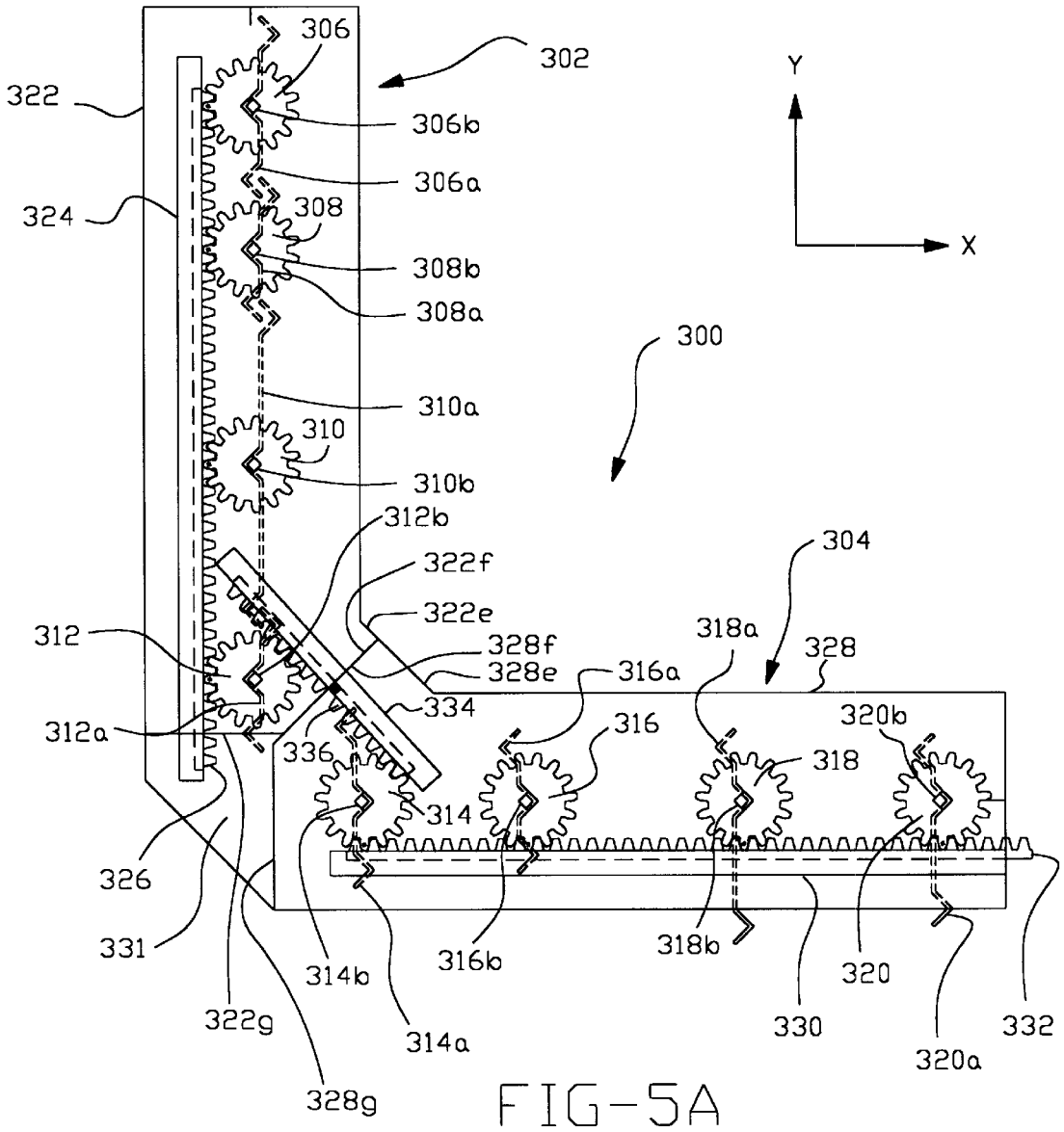
FIG. 5A illustrates the damper system of the present invention according to a second preferred embodiment.
Figure 5B:
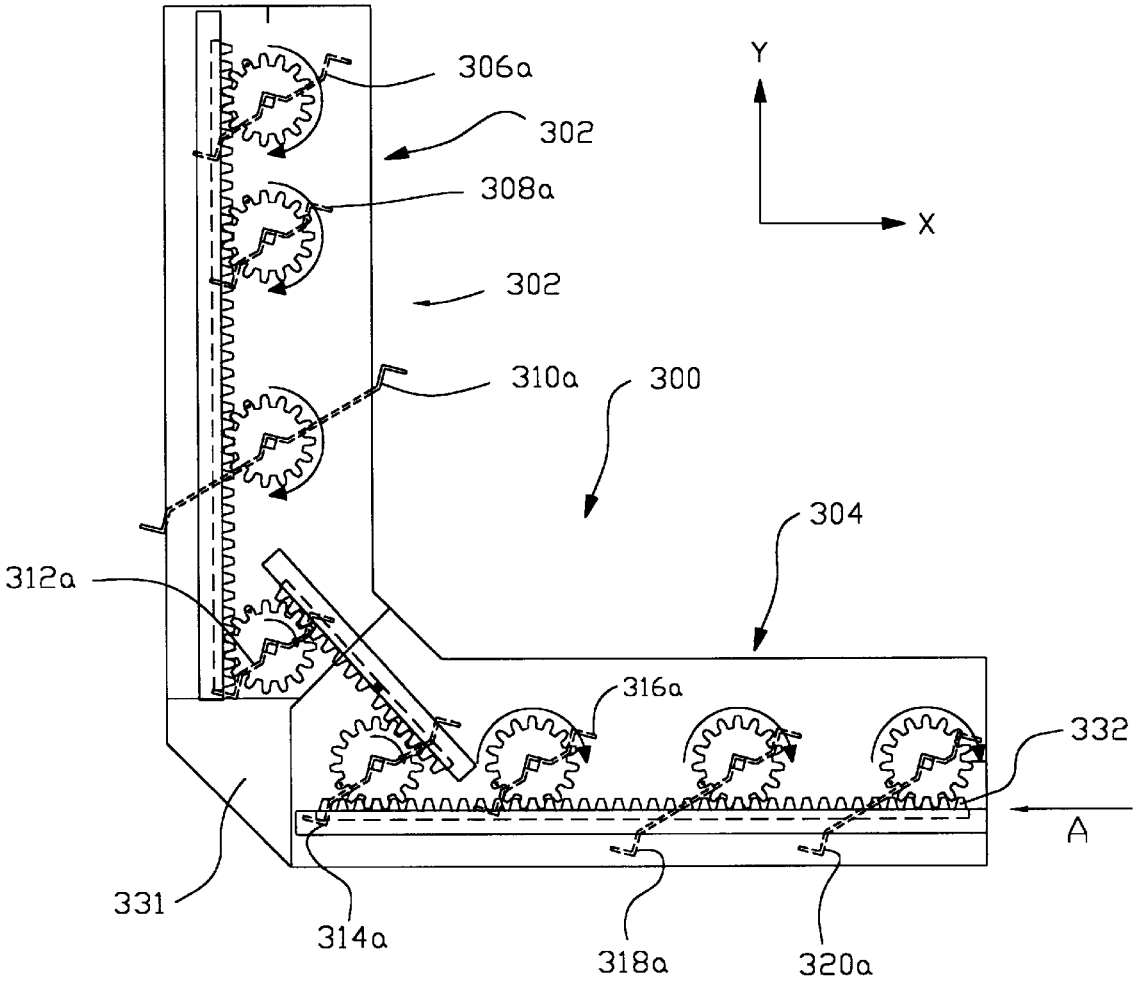
FIG. 5B illustrates the complimentary actuation of the fresh air damper and the return air damper of the damper system of FIG. 5A.

FIGS. 5A and 5B show a second preferred embodiment of the present invention. As shown in FIG. 5A, damper system 300 has fresh air damper 302 and return air damper 304 in a non-coplanar, 90 degree arrangement. Therefore, damper system 300 is utilized in installations having a fresh air duct with a longitudinal axis generally normal to the y-axis and a return air duct with a longitudinal axis generally normal to the x-axis, as shown in FIG. 5A. Although not shown in FIG. 5A, fresh air damper 302 and return air damper 304 can be positioned in other, non-coplanar arrangements for angles from 90 to 180 degrees, or for angles from 0 to 90 degrees, depending on the specific installation.

Fresh air damper 302 has non-interlocking damper gears 306,308,310, and 312 having hubs 306*b*, 308*b*, 310*b*, and 312*b*, respectively. Damper blades 306*a*, 308*a*, 310*a*, and 312*a* are preferably coupled to damper gears 306, 308, 310, and 312 in a parallel fashion. Damper blades 306*a*, 308*a* 310*a*, and 312*a* are also rotatably supported by a housing 322. Return air damper 304 has non-interlocking damper gears 314, 316, 318, and 320 having hubs 314*b*, 316*b*, 318*b*, and 320*b*, respectively. Damper blades 314*a*, 316*a*, 318*a*, and 320*a* are preferably coupled to damper gears 314, 316, 318, 320 in a parallel fashion. Damper blades 314*a*, 316*a*, 318*a*, and 320*a* are also rotatably supported by a housing 328. All damper gears in damper system 300 have substantially identical diameters and the same number of teeth. In addition, all damper gears in damper system 300 are preferably spur gears and preferably have involute gear teeth.

In damper system 300, housings 322 and 328, the damper blades, the damper gears, and the interconnection of the damper blades, housings, damper gears, and control motor are all substantially similar to such structure and interconnections of damper system 200, with the following important modifications. First, fresh air damper 302 has a support means 324 and a rack 326, and return air damper 304 has a support means 330 and a rack 332. Separate support means and racks for fresh air damper 302 and return air damper 304 are due to the non-coplanar design of damper system 300. Second, housing 322 preferably has truncated portions 322*e*, 322*f*, and 322*g*, and housing 328 preferably has truncated portions 328*e*, 328*f*, and 328*g*. These modifications to housings 322 and 328 are also due to the non-coplanar design of damper system 300. Third, damper system 300 preferably has a support section 331 that supports housing 322 and housing 328 in a 90 degree position relative to each other. Fourth, damper system 300 includes a connecting means coupling fresh air damper 302 and return air damper 304. This connecting means includes a support means 334 and a rack 336. Rack 336 is movably disposed within support means 334, and rack 336 has a plurality of teeth engaging damper gears 312 and 314. Similar to support means 324 and support means 330, support means 334 is preferably made from aluminum or other conventional low friction material. Similar to support means 324 and 330, support means 334 also preferably has a L-shaped cross-section, although one skilled in the art will appreciate that the exact geometry of support means 334 is not critical as long as it supports rack 336 in engagement with damper gears 312 and 314 and allows sliding movement of rack 336. Similar to racks 326 and 332, rack 336 is preferably made from a conventional wear resistant, low friction material such as Zamak 3, a zinc alloy. Fifth, control motor 30 (not shown) can be rotatably coupled to rack 326, rack 332, or rack 336 or to one of the damper gears in damper system 300. This coupling is preferably accomplished using a drive gear coupled to rack 326, rack 332, or rack 336; a shaft of control motor 30 coupled to a hub of damper gear, or other conventional drive means.

As best shown by FIG. 5B, the non-interlocking gears of damper system 300 allow damper blades 306*a*, 308*a*, 310*a*, 312*a*, 314*a*, 316*a*, 318*a*, and 320*a* to have various widths. Such flexibility is critical in installations in ducts which have widths not evenly divisible into a number of equal width damper blades. The motion of fresh air damper 302 is slaved to return air damper 304 by a combination of support means 334 and rack 336. For example, if control motor 30 (not shown) moves rack 332 in the direction of arrow A in FIG. 5B, damper gears 314, 316, 318, and 320 of return air damper 304 and damper gears 306, 308, 310, and 312 of fresh air damper 302 each rotate clockwise by the same angular displacement. In addition, as shown best by FIG. 5A, the damper blades of fresh air damper 302 are preferably oriented 90 degrees out of phase with the damper blades of return air damper 304. Therefore, control motor 30 (not shown) actuates fresh air damper 302 and return air damper 304 in a complimentary manner. For example, as shown in FIG. 5A, when fresh air damper 302 is fully closed (all damper blades at 0 degrees with respect to the y-axis), return air damper 304 is fully open (all damper blades at 90 degrees with respect to the x-axis). As another example, as shown in FIG. 5B, if fresh air damper 302 is open to 60 degrees with respect to the y-axis, return air damper 304 is opened to the complimentary angle of 30 degrees with respect to the x-axis.

Of course, although not shown in FIGS. 5A and 5B, damper system 300 can also be implemented so that damper blades 306*a*, 308*a*, 310*a*, 312*a*, 314*a*, 316*a*, 318*a*, and 320*a* have equal widths. In addition, although FIGS. 5A and 5B show fresh air damper 302 as having four damper blades and return air damper 304 as having four damper blades, fresh air damper 302 and return air damper 304 can have fewer or greater numbers of damper blades, and fresh air damper 302 can have a different number of damper blades than return air damper 304.

Figure 6:
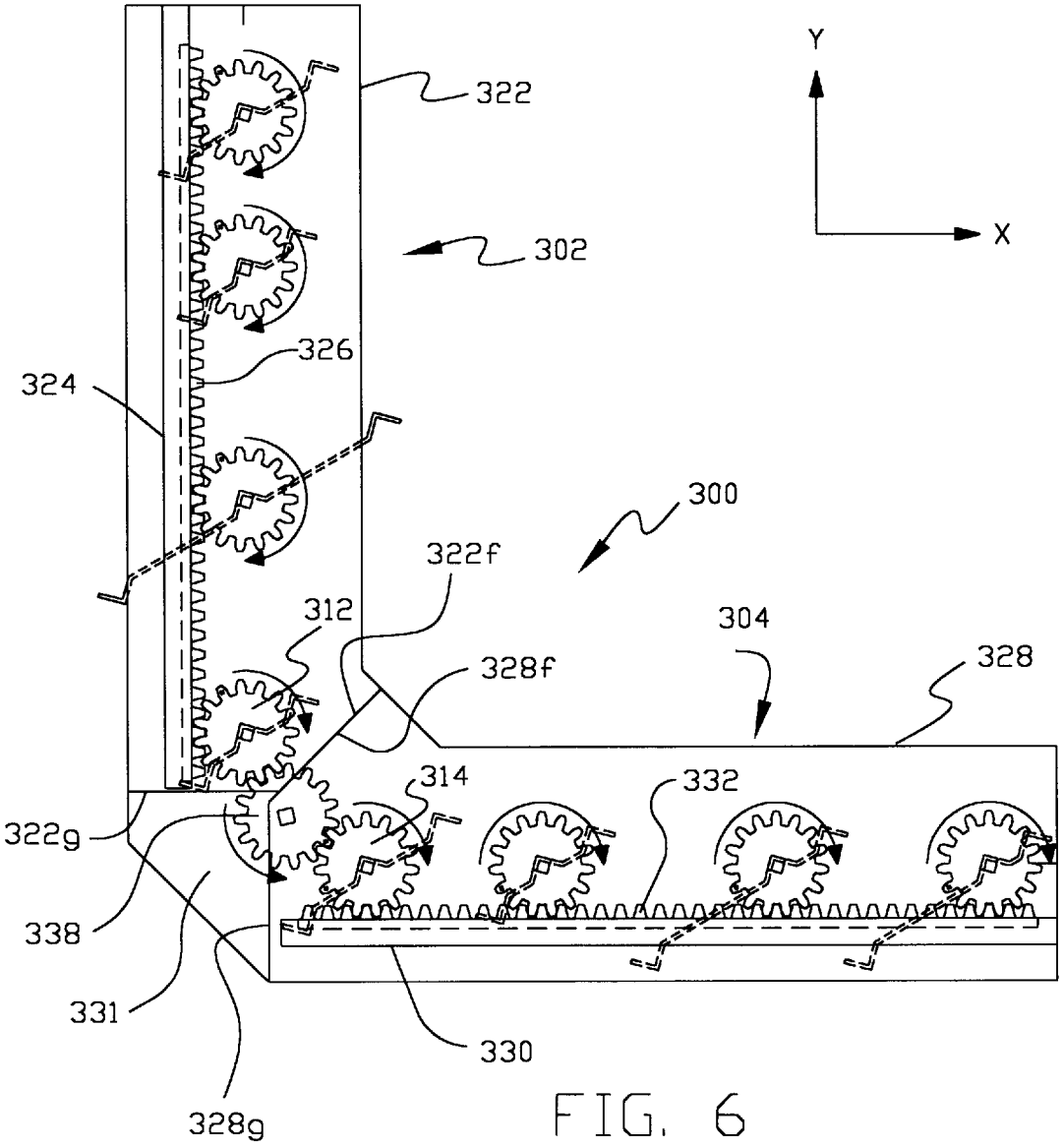
FIG. 6 illustrates an alternate embodiment of the connecting means of the damper system of FIG. 5A.

Referring now to FIG. 6, an alternate connecting means for damper system 300, a gear 338, is illustrated. Gear 338 is preferably rotatably supported, in a manner similar to the damper gears. on housing 328 proximate truncated portions 328*f* and 328*g*. Gear 338 is engaged with damper gear 312 of fresh air damper 302 and damper gear 314 of return air damper 304. Gear 338 thus allows control motor 30 (not shown) to actuate fresh air damper 302 and return air damper 304 in a complimentary manner, as is described above. To minimize manufacturing costs, gear 338 is preferably a spur gear with involute gear teeth having a substantially identical diameter and the same number of teeth as the damper gears of damper system 300. However, one skilled in the art will appreciate that gear 338 could have a different diameter and a different number of teeth than the damper gears of damper system 300, and although not shown in FIG. 6, multiple mating gears could also be utilized in place of gear 338. In addition, gear 338 could alternately be rotatably supported on support section 331 or housing 322 proximate truncated portions 322*f* and 322*g*.

FIGS. 7 through 10 illustrate the preferred structure of the damper gears and racks for the present invention in greater detail. Although described in connection with fresh air damper 202 of damper system 200, these preferred damper gears and racks can be implemented in return air damper 204 of damper system 200, fresh air damper 302 of damper system 300, return air damper 304 of damper system 300, or in any similar damper or damper system.

Figure 7:
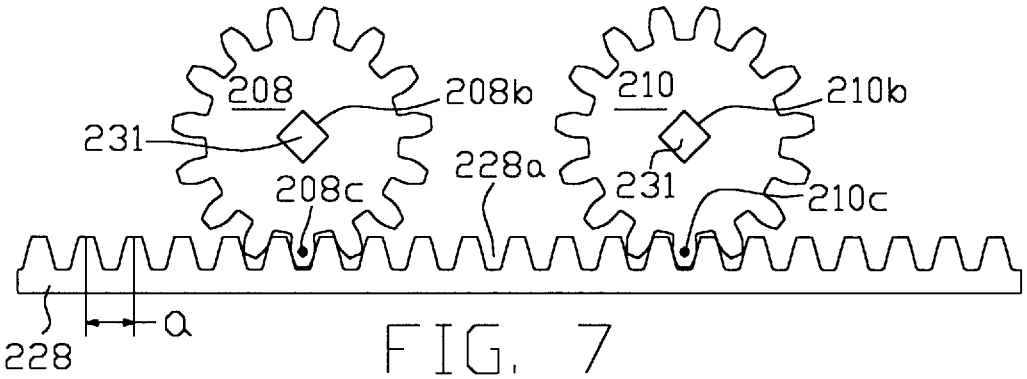
FIG. 7 shows a detailed view of the preferred structure of the damper gears and rack of the present invention.

Referring to FIG. 7, damper gears 208 and 210 represent any two, adjacent damper gears in fresh air damper 202. Damper gear 208 has an odd number of teeth. As described above in connection with FIGS. 4A and 4C, damper gear 208 has hub 208*b* with a square cross-section, and hub 208*b* receives bearing 230*a* of damper blade 208*a* having a portion 231 with a mating, square cross-section. Damper gear 208 also has a top dead center 208*c*, in which one of the teeth of damper gear 208 is in axial alignment with a corner of square-shaped hub 208*b*. Similar to damper gear 208, damper gear 210 has an odd number of teeth, a hub 208*b* with a square cross-section receiving bearing portion 231 of damper blade 210*a*, and a top dead center 210*c*. Rack 228 has a plurality of teeth with a constant center-to-center spacing of "a". Rack 228 also has a plurality of valleys 228*a* separating each of its teeth. Of course, the minimum center-to-center spacing "x" of damper gears 208 and 210 must be greater than the diameter of the damper gears to avoid interference.

The above-described structure of damper gears 208 and 210 and rack 228 provides significant advantages in the installation of fresh air damper 202 within various ducts. As shown in FIG. 7, if damper gears 208 and 210 are engaged with rack 228 so that top dead centers 208*c* and 210*c* are each positioned in a valley 228*a* of rack 228, the center-to-center spacing of damper gears 208 and 210 can be adjusted in "a" unit increments from a minimum value of "x" units. For example, assuming "a" was 0.5 inches and the minimum center-to-center spacing "x" of damper gears 208 and 210 was 4 inches, the spacing of damper gears 208 and 210 could be adjusted to 4 inches, 4.5 inches, 5 inches, or a higher increment of 0.5 inches. Since damper blade widths are related to damper gear spacing, such flexibility of damper gear spacing also provides flexibility of damper blades widths, which is important in installations having a variety of duct widths.

Figure 8:
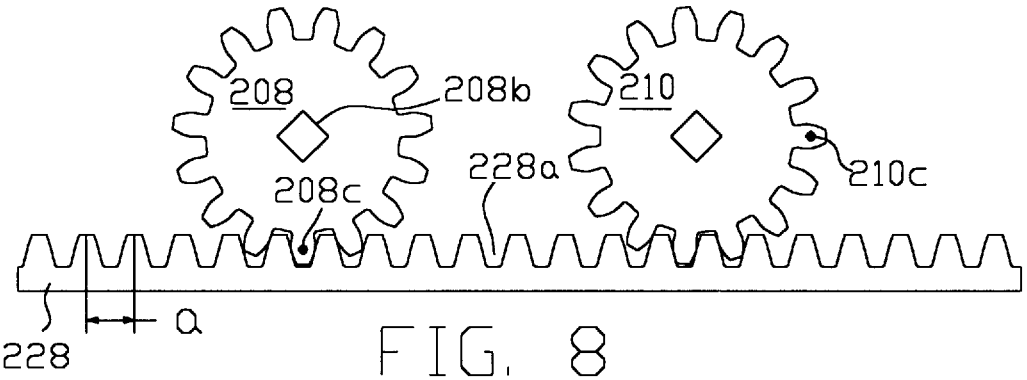
FIGS. 8, 9, and 10 show alternate, preferred positionings of the damper gears and rack of FIG. 7.

FIG. 8 shows the preferred damper gear and rack structure of FIG. 7 in which damper gears 208 and 210 are each engaged with rack 228 so that top dead center 208*c* is positioned within a valley 228*a* of rack 228, and top dead center 210*c* is positioned 90 degrees out of phase with top dead center 208*c*. With this positioning, the center-to-center spacing of damper gears 208 and 210 can be adjusted in "a" unit increments from a minimum value of "x+a/4" units. For example, assuming "a" was 0.5 inches and the minimum center-to-center spacing "x" of damper gears 208 and 210 was 4 inches, the spacing of damper gears 208 and 210 could be adjusted to 4.125 inches. 4.625 inches, 5.125 inches, or a higher increment of 0.5 inches.

Figure 9:
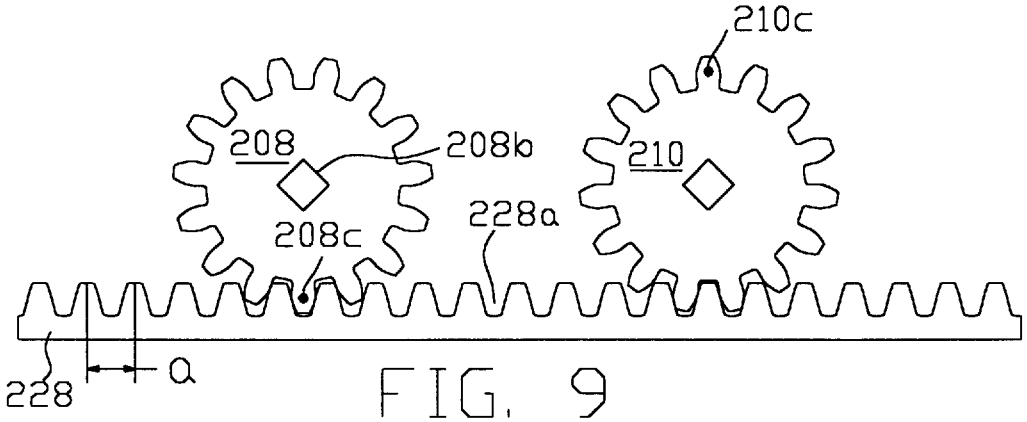

FIG. 9 shows the preferred damper gear and rack structure of FIG. 7 in which damper gears 208 and 210 are engaged with rack 228 so that top dead center 208*c* is positioned within a valley 228*a* of rack 228, and top dead center 210*c* is positioned 180 degrees out of phase with top dead center 208*c*. With this positioning, the center-to-center spacing of damper gears 208 and 210 can be adjusted in "a" unit increments from a minimum value of "x+a/2" units. For example, assuming "a" was 0.5 inches and the minimum center-to-center spacing "x" of damper gears 208 and 210 was 4 inches, the spacing of damper gears 208 and 210 could be adjusted to 4.25 inches, 4.75 inches, 5.25 inches, or a higher increment of 0.5 inches.

Figure 10:
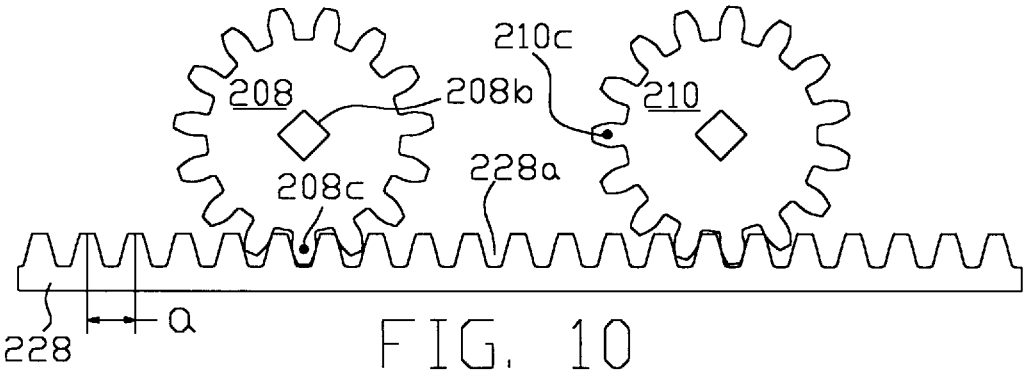

FIG. 10 shows the preferred damper gear and rack structure of FIG. 7 in which damper gears 208 and 210 are engaged with rack 228 so that top dead center 208*c* is positioned within a valley 228*a* of rack 228, and top dead center 210*c* is positioned 270 degrees out of phase with top dead center 208*c*. With this positioning, the center-to-center spacing of damper gears 208 and 210 can be adjusted in "a" unit increments from a minimum value of "x+3a/4" units.

For example, assuming "a" was 0.5 inches and the minimum center-to-center spacing "x" of damper gears 208 and 210 was 4 inches, the spacing of damper gears 208 and 210 could be adjusted to 4.375 inches, 4.875 inches, 5.375 inches, or a higher increment of 0.5 inches.

Although not shown in FIGS. 7–10, hubs 208*b* and 210*b* and portions 231 can have any polygonal cross-section, such as a triangle, pentagon, hexagon, or other polygon. For a polygon with "n" sides, n different ways to orient top dead center 208*c* and 210*c* on rack 228 exist. Therefore, one skilled in the art can appreciate that the preferred damper gear and rack structure of the present invention provides a significant number of damper gear spacings, and thus damper blade widths, by modifying the damper gear hub to various polygonal cross-sections, and by modifying the relative orientation of the top dead center of adjacent damper gears in rack 228*a*.

From the above, it may be appreciated that the preferred embodiments of the present invention provide an improved damper system for positioning proximate to or in a duct which minimizes the number of moving parts and minimizes the degree of precision adjustment required. during manufacturing, installation, and maintenance. The damper system of the present invention allows the use of damper blades of varying widths, which is especially important in ducts having widths not evenly divisible into a number of equal width damper blades. As the damper system of the present invention only requires a single diameter of damper gear, it also reduces manufacturing costs by only requiring a single die to cast the damper gears. Finally, the present invention is easily incorporated into system having a fresh air damper and a return air damper which are actuated in a complimentary manner.

The present invention is illustrated herein by example, and various modifications may be made by a person of ordinary skill in the art. For example, while the preferred embodiments have been described in connection with an HVAC system, the present invention is fully applicable to any conduit or duct requiring a damper system. As another example, although the preferred embodiments have been described using spur gears, the present invention is fully applicable with helical or other conventional gears. As a further example, although the preferred embodiments have been described using involute gear teeth for all gears, other gear tooth shapes may be utilized. As a further example, although the preferred embodiments have been described using separate, but connected, housings for a fresh air damper and a return air damper, a single, integrally formed housing for both the fresh air damper and return air damper may be utilized. As a further example, although the preferred embodiments have been described using a bearing and bushing combination to rotatably support opposing ends of a damper blade in a housing, the present invention is fully applicable with a damper blade having a shaft rotatably supported within bearings or apertures in a housing. As a further example, although the preferred embodiments have been described using a fresh air damper and a return air damper which are actuated in a complimentary manner, the present invention is fully applicable to systems in which the fresh air damper and return air damper are actuated in a "slaved", but non-complimentary fashion. As a final example, numerous interconnections and/or geometries could be altered to accommodate a given damper system installation. Consequently, while the present invention has been described in detail, various substitutions, modifications, or alterations could be made to the description set forth above without departing from the invention which is defined by the following claims.

What is claimed is:

1. A damper blade system for positioning proximate first and second ducts, comprising:

a housing having a first side and a second side opposing said first side;

a first damper for said first duct, comprising:

a first damper blade having first and second ends, said first end rotatably supported in said first side of said housing and coupled to a first damper gear, said second end rotatably supported in said second side of said housing;

a second damper blade having first and second ends, said first end rotatably supported in said first side of said housing and coupled to a second damper gear, said second end rotatably supported in said second side of said housing, said second damper blade disposed adjacent said first damper blade;

a first support means disposed on said first side of said housing; and a first rack movably disposed in said first support means, said rack having a plurality of teeth engaging said first and second damper gears;

a second damper for said second duct and non-coplanar with said first damper, comprising:

a third damper blade having first and second ends, said first end rotatably supported in said first side of said housing and coupled to a third damper gear, said second end rotatably supported in said second side of said housing;

a fourth damper blade having first and second ends, said first end rotatably supported in said first side of said housing and coupled to a fourth damper gear, said second end rotatably supported in said second side of said housing, said fourth damper blade disposed adjacent said third damper blade;

a second support means disposed on said first side of said housing; and a second rack movably disposed in said second support means, said second rack having a plurality of teeth engaging said third and fourth damper gears;

connecting means for coupling said first damper with said second damper; and drive means, rotatably coupled to said first damper, said second damper, or said connecting means, for moving said first rack along said first support means, and for moving said second rack along said second support means.

2. The damper blade system of claim 1 wherein when said first rack and second rack are moved by said drive means and said connecting means, said first and second damper blades are each positioned, with respect to said first duct, to a substantially identical angle between 0 and 90 degrees, and said third and fourth damper blades are each positioned, with respect to said second duct, to a substantially complimentary angle to said identical angle.

3. The damper blade system of claim 2 wherein said first, second, third, and fourth damper gears have substantially identical diameters and a same number of teeth.

4. The damper blade system of claim 3 wherein said first and second damper blades have substantially identical widths.

5. The damper blade system of claim 3 wherein said first and second damper blades have different widths.

6. The damper blade system of claim 3 wherein said third and fourth damper blades have substantially identical widths.

7. The damper blade system of claim 3 wherein said third and fourth damper blades have different widths.

8. The damper blade system of claim 1 wherein said connecting means comprises:

a third support means disposed on said first side of said housing; and a third rack movably disposed in said third support means, said third rack having a plurality of teeth engaging said first damper gear and said third damper gear.

9. The damper blade system of claim 1 wherein:

said first end of said first damper blade has a polygonal cross-section;

said first end of said second damper blade has said polygonal cross-section;

said first and second damper gears each have:

a hub with a mating polygonal cross-section to said polygonal cross-section of said first ends of said first and second damper blades;

a substantially identical diameter;

a same, odd number of teeth; and a top dead center.

10. The damper blade system of claim 9 wherein:

said top dead center of said first damper gear is positioned within a valley of said first rack; and said top dead center of said second damper gear is positioned within a second valley of said first rack.

11. The damper blade system of claim 9 wherein:

said top dead center of said first damper gear is positioned within a valley of said first rack; and said top dead center of said second damper gear is positioned out of phase with said top dead center of said first damper gear.

12. The damper blade system of claim 11 wherein said top dead center of said second damper gear is oriented in a selected one of a plurality of positions responsive to a number of sides of said mating polygonal cross-section.

13. The damper blade system of claim 12 wherein:

said mating polygonal cross-section is a square; and said top dead center of said second damper gear is positioned 90 degrees out of phase with said top dead center of said first damper gear.

14. The damper blade system of claim 12 wherein:

said mating polygonal cross-section is a square; and said top dead center of said second damper gear is positioned 180 degrees out of phase with said top dead center of said first damper gear.

15. The damper blade system of claim 12 wherein:

said mating polygonal cross-section is a square; and said top dead center of said second damper gear is positioned 270 degrees out of phase with said top dead center of said first damper gear.

* * * * *

UNITED STATES PATENT AND TRADEMARK OFFICE

CERTIFICATE OF CORRECTION

PATENT NO : 5,836,814

DATED : November 17, 1998

INVENTOR(S) : Robert Ashley Cunningham, Jr.

It is certified that error appears in the above-identified patent and that said Letters Patent is hereby corrected as shown below:

Column 1, Line 38
Delete: [filly]
Insert: –fully--

Column 3, Line 48
Delete: [.] after "in"

Column 4, Line 61
Delete: [.] after "equal"

Column 5, Line 2
Delete: [or]
Insert: –on--

Column 5, Line 59
Delete: [.] after "preferred"

UNITED STATES PATENT AND TRADEMARK OFFICE

CERTIFICATE OF CORRECTION

PATENT NO : 5,836,814

DATED : November 17, 1998

INVENTOR(S) : Robert Ashley Cunninghams, Jr.

It is certified that error appears in the above-identified patent and that said Letters Patent is hereby corrected as shown below:

Column 9, Line 40

Delete: [.] after "gears"

Insert: –,-- after "gears"

Column 10, Line 45

Delete: [.] after "4.125 inches"

Insert: –,-- after "4.125 inches"

Column 11, Line 22

Delete: [.] after "required"

Signed and Sealed this

Twenty-fifth Day of July, 2000

*Attest:*

Q. TODD DICKINSON

*Attesting Officer*

*Director of Patents and Trademarks*